US010472702B2

(12) United States Patent
Yeh et al.

(10) Patent No.: US 10,472,702 B2
(45) Date of Patent: Nov. 12, 2019

(54) HIGH-ENTROPY SUPERALLOY

(71) Applicant: National Tsing Hua University, Hsinchu (TW)

(72) Inventors: An-Chou Yeh, Hsinchu (TW); Te-Kang Tsao, Hsinchu (TW)

(73) Assignee: National Tsing Hua University (TW)

( * ) Notice: Subject to any disclaimer, the term of this patent is extended or adjusted under 35 U.S.C. 154(b) by 639 days.

(21) Appl. No.: 15/292,256

(22) Filed: Oct. 13, 2016

(65) Prior Publication Data

US 2017/0369970 A1 Dec. 28, 2017

(30) Foreign Application Priority Data

Jun. 22, 2016 (TW) ..... 105119510 A

(51) Int. Cl.
*C22C 19/05* (2006.01)
*C22C 30/00* (2006.01)

(52) U.S. Cl.
CPC ..... *C22C 19/058* (2013.01); *C22C 30/00* (2013.01)

(58) Field of Classification Search
None
See application file for complete search history.

(56) References Cited

U.S. PATENT DOCUMENTS 4,261,742 A * 4/1981 Coupland ..... C22C 19/05 420/1
5,151,249 A * 9/1992 Austin ..... C22C 19/057 420/445
5,482,789 A * 1/1996 O'Hara ..... C22C 19/057 428/652
6,007,645 A * 12/1999 Cetel ..... C22C 19/057 148/404
2008/0170961 A1* 7/2008 Seetharaman ..... C22C 19/05 420/445
2009/0196760 A1* 8/2009 Harada ..... C22C 1/0433 416/241 R
2010/0143182 A1* 6/2010 Sato ..... C22C 19/00 420/444
2011/0142714 A1* 6/2011 Harada ..... C22C 19/057 420/445
2011/0262299 A1* 10/2011 Harada ..... C22C 19/057 420/447
2016/0326616 A1* 11/2016 Park ..... C22C 30/00
2017/0314410 A1* 11/2017 Liu ..... F01D 11/122

FOREIGN PATENT DOCUMENTS

CA 2276154 A1 * 1/2000

OTHER PUBLICATIONS

Inconel Material Data Sheet, http://asm.matweb.com/search/SpecificMaterial.asp?bassnum=NINC34, no date available; 2 pages.*
"Why Choosing Inconel 718 for Aerospace Additive Manufacturing?"; Farinia Group, https://www.farinia.com/additive-manufacturing/3d-materials/inconel-718-aerospace-additive-manufacturing, no date available; 5 pages.*
Helmer et al. "Additive manufacturing of nickel-based superalloy Inconel 718 by selective electron beam melting: Processing window and microstructure"; J. Mater. Res.,vol. 29, Issue 19, Sep. 2014, pp. 1987-1996; 10 pages.*

* cited by examiner

*Primary Examiner* — Helene Klemanski

(57) ABSTRACT

Differing from traditional alloys often containing one primary elemental composition, the present invention reforms a conventional superalloy to a high-entropy superalloy by redesigning the elemental compositions of the conventional superalloy based on a mixing entropy formula. Particularly, this high-entropy superalloy shows advantages of light weight and low cost under the premise of containing a low amount of expensive metal composition. The proposed high-entropy superalloy of the present invention comprises a primary elemental composition and at least one principal strengthening elemental composition, wherein the primary elemental composition has a first element content of at least 35 at % and each of the principal strengthening elemental compositions have a second element content of over 5 at %. Moreover, a variety of experimental results have proved that the high-entropy superalloy simultaneously possesses a variety of excellent high-temperature mechanical properties, such as high mechanical strength, high corrosion resistance, high oxidation resistance, and high creep resistance.

8 Claims, 7 Drawing Sheets

HIGH-ENTROPY SUPERALLOY

BACKGROUND OF THE INVENTION

1. Field of the Invention

The present invention relates to the technology field of alloy materials, and more particularly to a high-entropy superalloy.

2. Description of the Prior Art

Superalloy has become a high economic material for high temperature application because of possessing a variety of high-temperature mechanical properties. Besides being able to be long used under high temperature of above 650° C., various superalloys may also simultaneously exhibit other outstanding high-temperature mechanical properties such as high corrosion resistance, high creep strength, high wear resistance, high fatigue resistance, or high oxidation resistance under. The applications of superalloys are integrated and listed in following Table (1).

TABLE 1

| Application field | Needed high-temperature mechanical properties for the applied superalloys | Products in related application field |
|---|---|---|
| Aerospace industry | Excellent high-temperature mechanical strength | Airplane engines, gas turbine engines, and engine valves |
| Energy industry | High oxidation and sulfidation resistance | Desalination plants and petrochemical pipelines |
| electronic industry | High corrosion resistance and thermal stability | Battery housings, lead frames, and camera housings |

Conventional superalloys are divided into iron-nickel based superalloy, cobalt based superalloy and nickel based superalloy, wherein the nickel based superalloy is one kind of traditional superalloy early developed, which is made by using nickel (Ni) as a primary elemental composition with a primary weight percentage in a range from 30 wt % to 50 wt % as well as adding a strengthening element such as Al, Co, Cr, Ti, or Nb into the nickel based superalloy for enhancing the creep strength. Moreover, it can further add at least one firebrick element into the nickel based superalloy for making the nickel based superalloy exhibit outstanding fatigue resistance and creep strength under high temperature; for example, Mo, Ta, W, Re, or Ru. However, resulted from all the firebrick elements belong to precious metals, the adding of the firebrick elements not only causes the manufacturing cost and selling price of the nickel based superalloy be too expensive, bus also limits the application scopes of the nickel based superalloy due to the costly selling price.

In view of the quality-price ratio of the traditional nickel based superalloy being too low, researchers and engineers skilled in the alloy developing and manufacturing field hence propose a nickel-iron based superalloy. The nickel-iron based superalloy is made by using two primary elemental compositions of nickel (Ni) and iron (Fe) as well as adding at least one trace element such as Al, Cr, Ti, or Nb into the nickel-iron based superalloy. On the other hand, some nickel-iron based superalloys also contain at least one solid solution strengthening composition, for instance, Mo, W, or Co. As the researchers and engineers skilled in the alloy developing and manufacturing field know, when using aluminum (Al) as the trace element added into the nickel-iron based superalloy, it must properly control the weight percentage of the aluminum to be less than 5 wt %. The reason is that at least one intermetallic phase not belonging to any precipitation strengthening phases would be produced in the internal of the nickel-iron based superalloy when the nickel-iron based superalloy simultaneously contains high content iron (Fe) and aluminum (Al) with the weight percentage exceeding 5 wt %. The most important is that the production of the intermetallic phase such as $Ni_2AlTi$ or Ni(Al, Ti) would decrease the high-temperature creep strength and the high-temperature mechanical properties of the nickel-iron based superalloy.

So that, resulted from both the traditional nickel based superalloy and the conventional nickel-iron based superalloy showing drawbacks and shortcomings in practical applications, the inventors of the present application have made great efforts to make inventive research thereon and eventually provided a high-entropy superalloy.

SUMMARY OF THE INVENTION

The primary objective of the present invention is to provide a high-entropy superalloy. Differing from traditional alloys often containing one kind of primary elemental composition, for example, nickel (Ni) is the primary elemental composition of a nickel-based superalloy, the present invention reforms a conventional superalloy to a high-entropy superalloy by redesigning the elemental compositions of the conventional superalloy based on a mixing entropy formula. Particularly, this high-entropy superalloy shows advantages of light weight and low manufacturing cost under the premise of containing a low amount of expensive metal composition. The proposed high-entropy superalloy of the present invention comprises a primary elemental composition and at least one principal strengthening elemental composition, wherein the primary elemental composition has a first element content of at least 35 at % and each the principal strengthening elemental compositions has a second element content of over 5 at %. Moreover, a variety of experimental results have proved that the high-entropy superalloy simultaneously possesses a variety of excellent high-temperature mechanical properties, such as high mechanical strength, high corrosion resistance, high oxidation resistance, and high creep resistance.

In order to achieve the primary objective of the present invention, the inventor of the present invention provides an embodiment for the high-entropy superalloy, comprising following elemental compositions and technology features for constituting the elemental compositions to the high-entropy superalloy:

at least one primary elemental composition, being a siderophile element for forming a base phase structure of the high-entropy superalloy, wherein the primary elemental composition has a first element content of at least 35 at %; and at least one principal strengthening elemental composition for forming at least one precipitation strengthening phase structure, wherein each the principal strengthening elemental composition has a second element content of over 5 at %;

wherein the first element content and the second element content are determined by a mixing entropy of the primary elemental composition and the principal strengthening elemental composition, and the absolute value of the mixing entropy being over 1.5 R.

For the embodiment of the high-entropy superalloy, the siderophile element can be nickel (Ni), titanium (Ti), vanadium (V), chromium (Cr), manganese (Mn), iron (Fe), cobalt (Co), or platinum group element (PGE).

For the embodiment of the high-entropy superalloy, the principal strengthening elemental composition can be aluminum (Al), cobalt (Co), chromium (Cr), copper (Cu), iron (Fe), manganese (Mn), niobium (Nb), titanium (Ti), vanadium (V), zirconium (Zr), or combination of the aforesaid two or more elements.

For the embodiment of the high-entropy superalloy, which can be made by using a manufacturing method selected from the group consisting of: atmospheric melting method, vacuum arc melting method, vacuum induction melting method, electric resistance wire heating method, electric induction heating method, rapidly solidification method, mechanical ball-milling method, powder metallurgic method, and additive manufacturing method.

For the embodiment of the high-entropy superalloy, wherein a product or a semi-product of the high-entropy superalloy can be a powder, a wire, a welding rod, a cored wire, or a bulk.

For the embodiment of the high-entropy superalloy, which can be coated on the surface of a target workpiece by a processing method selected from the group consisting of: casting method, electric-arc welding method, thermal spraying method, and thermal sintering method.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

Figure 1:
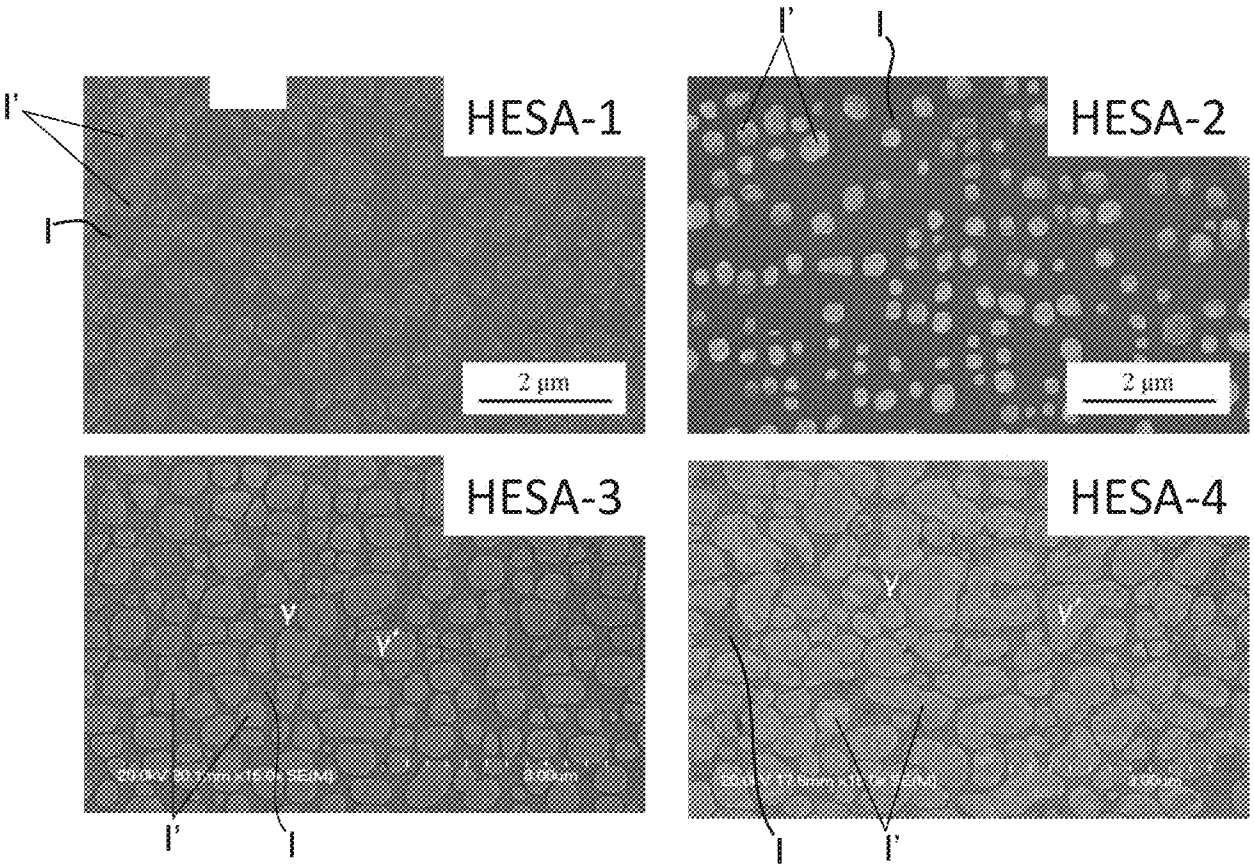
FIG. 1 shows four SEM images of different samples of a high-entropy superalloy proposed by the present invention.

To more clearly describe a high-entropy superalloy according to the present invention, embodiments of the present invention will be described in detail with reference to the attached drawings hereinafter.

Traditional alloys often contain one kind of primary elemental composition, for example, nickel (Ni) is the primary elemental composition of a nickel-based superalloy. Differing from the traditional alloys, a high-entropy superalloy, composed by a plurality of primary elemental compositions, has developed and proposed in the present invention. To fabricate the said high-entropy superalloy, it needs to make each of the primary elemental compositions have an element content of 5-35 at %.

First embodiment:

In follows, a first embodiment of the high-entropy superalloy is made according to a first technology feature proposed by the present invention. The first technology feature is that to constitute one primary elemental composition and at least one principal strengthening elemental composition to a high-entropy superalloy by using a (mixing) entropy calculation equation. For fabricating the high-entropy superalloy, the primary element must be a siderophile element for forming a base phase structure of the high-entropy superalloy, and the primary elemental composition has a first element content of at least 35 at %. To detail describe the primary elemental composition, wherein the siderophile element can be a transition metal element of nickel (Ni), titanium (Ti), vanadium (V), chromium (Cr), manganese (Mn), iron (Fe), cobalt (Co), or platinum group element (PGE). On the other hand, the principal strengthening element, such as aluminum (Al), cobalt (Co), chromium (Cr), copper (Cu), iron (Fe), manganese (Mn), niobium (Nb), titanium (Ti), vanadium (V), zirconium (Zr), or combination of the aforesaid two or more elements, is adopted for forming at least one precipitation strengthening phase structure in the high-entropy superalloy, wherein each the principal strengthening elemental composition has a second element content of over 5 at %.

Moreover, according to a second technology feature of the present invention, the absolute value of a mixing entropy of the primary elemental composition and the principal strengthening elemental composition must be greater than 1.5 R. In brief, the second technology feature is to determine the first element content and the second element content by the mixing entropy through the said entropy calculation equation. As engineers skilled in alloy developing and manufacturing technology field know, the entropy calculation equation is presented by following mathematical formula. In the mathematical formula, $X_A$ and $X_B$ represent an element A's and an element B's mole percent, respectively. Moreover, ln( ) means a natural logarithm $$\text{Mathematical formula: } \Delta S_{mix} = -R(X_A \ln(X_A) + X_B \ln(X_B) + \ldots + X_N \ln(X_N))$$

Continuously, in order to prove the high-entropy superalloy of the present invention developed and fabricated based on above two technology features is practicable and able to exhibit outstanding mechanical properties under high temperature, various samples of the high-entropy superalloy have made by using nickel (Ni) as the example of the siderophile element. The detail elemental compositions of the samples are integrated and recorded in following Table (2). Moreover, from Table (2), it can easily find that the samples 3, 4, and 5 can be the high-entropy superalloy defined by the present invention because their mixing entropy values are greater than 1.5 R.

TABLE 2

| Sample | Ni at % | Al at % | Co at % | Cr at % | Fe at % | Ti at % | mixing entropy (absolute value) |
|---|---|---|---|---|---|---|---|
| 1 | 58.2 | 10.0 | 13.8 | 6.3 | 4.9 | 6.8 | 1.32 R |
| 2 | 50.5 | 8.9 | 17.2 | 9.2 | 8.2 | 6.0 | 1.46 R |
| 3 | 42.7 | 7.8 | 20.6 | 12.2 | 11.5 | 5.2 | 1.55 R |
| 4 | 35.1 | 6.6 | 23.9 | 15.2 | 14.8 | 4.4 | 1.60 R |
| 5 | 43.9 | 3.9 | 22.3 | 11.7 | 11.8 | 6.4 | 1.58 R |

Please simultaneously refer to following Table (3), which records with the absolute values of the mixing entropy of commercial products belonging to first generation superalloy. From Table (3), the engineers skilled in alloy developing and manufacturing technology field can understand that, each of the first generation superalloys merely have a mixing entropy value ranging from 1 R to 1.35 R even if some commercial products belonging to first generation superalloy are able to simultaneously show outstanding mechanical strength and creep strength under high temperature. Thus, through Table (2) and Table (3), the engineers skilled in alloy developing and manufacturing technology field can easily find the basic difference between the first generation superalloy and the high-entropy superalloy of the present invention is the absolute value of mixing entropy.

TABLE 3

| | Nickel Based superalloy | | | |
|---|---|---|---|---|
| | PWA1480 | RENE'N4 | CMSX-3 | CM247LC |
| mixing entropy (absolute value) | 1.29 R | 1.30 R | 1.15 R | 1.29 R |

Second embodiment:

Moreover, the grain boundary strengthening element can be carbon (C), boron (B), hafnium (Hf), or combination of the aforesaid two or more elements; moreover, the grain boundary strengthening elemental composition is controlled to have a third element content of less than 7 at %. In brief, an adding amount of the grain boundary strengthening element cannot exceed fifteen percent of the high-entropy superalloy's total weight.

Third embodiment:

Furthermore, and at least one refractory element. For fabricating the high-entropy superalloy, the refractory element can be molybdenum (Mo), tantalum (Ta), tungsten (W), rhenium (Re), ruthenium (Ru), combination of the aforesaid two or more elements; moreover, the refractory element is controlled to have a fourth element content of less than 7 at %. It is worth noting that, the summation of the third element content and fourth element content in the third embodiment of the high-entropy superalloy must be less than 7 at %. In brief, the adding amount of the grain boundary strengthening element and the refractory element cannot exceed fifteen percent of the high-entropy superalloy's total weight.

Continuously, in order to prove the second embodiment and the third embodiment of the high-entropy superalloy are practicable and able to exhibit outstanding mechanical properties under high temperature, a variety of samples have made by using nickel (Ni) as the example of the siderophile element. The detail elemental compositions of the samples are integrated and recorded in following Table (4-1) and Table (4-2).

TABLE 4-1

| Sample | Ni at % | Al at % | Co at % | Cr at % | Fe at % | Ti at % |
|---|---|---|---|---|---|---|
| 6 | 51.0 | 5.0 | 18.0 | 7.0 | 9.0 | 5.0 |
| 7 | 48.0 | 10.3 | 17.0 | 7.5 | 9.0 | 5.8 |
| 8 | 47.8 | 10.2 | 16.9 | 7.4 | 8.9 | 5.8 |
| 9 | 50.3 | 10.3 | 17.0 | 7.5 | 9.0 | 3.5 |

TABLE 4-2

| Sample | Ta at % | Nb at % | Mo at % | W at % | C at % | mixing entropy (absolute value) |
|---|---|---|---|---|---|---|
| 6 | 2.0 | — | 1.5 | 1.5 | — | 1.56 R |
| 7 | 0.6 | — | 0.9 | 0.5 | 0.4 | 1.59 R |
| 8 | — | 1.2 | 0.9 | 0.5 | 0.4 | 1.60 R |
| 9 | 0.3 | — | 1.2 | 0.5 | 0.4 | 1.53 R |

Thus, From Table (4-1) and Table (4-2), it can easily find that each of the samples 6, 7, 8, and 9 can be the high-entropy superalloy defined by the present invention because their mixing entropy are greater than 1.5 R. Moreover, as following Table (5) shows, the samples 3-9 are simply called by notations of HESA-1, HESA-2, HESA-3, HESA-4, HESA-5A, HESA-5B, and HESA-5C, respectively.

TABLE 5

| Samples | Notations |
|---|---|
| 3 | HESA-1 |
| 4 | HESA-2 |
| 5 | HESA-3 |
| 6 | HESA-4 |
| 7 | HESA-5A |
| 8 | HESA-5B |
| 9 | HESA-5C |

Microstructure Analysis:

With reference to FIG. 1, where four SEM images of different samples of the high-entropy superalloy are provided. As FIG. 1 shows, after treating the samples 3, 4, 5, and 6 with an aging process under 900° C. for 300 hours, a base phase structure I and at least one precipitation strengthening phase structure I' are produced in the internal of the high-entropy superalloy samples; wherein the base phase structure I is a face centered cubic (FCC) structure and the precipitation strengthening phase structure I' is an ordered γ' phase with L12 crystal structure.

Figure 2:
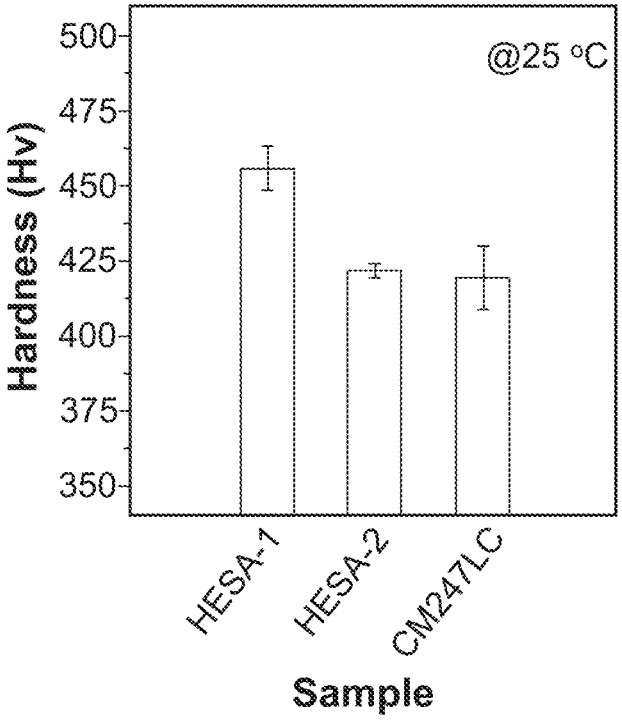
FIG. 2 presents a statistics bar chart showing hardness values of different high-entropy superalloy samples.
Figure 3:
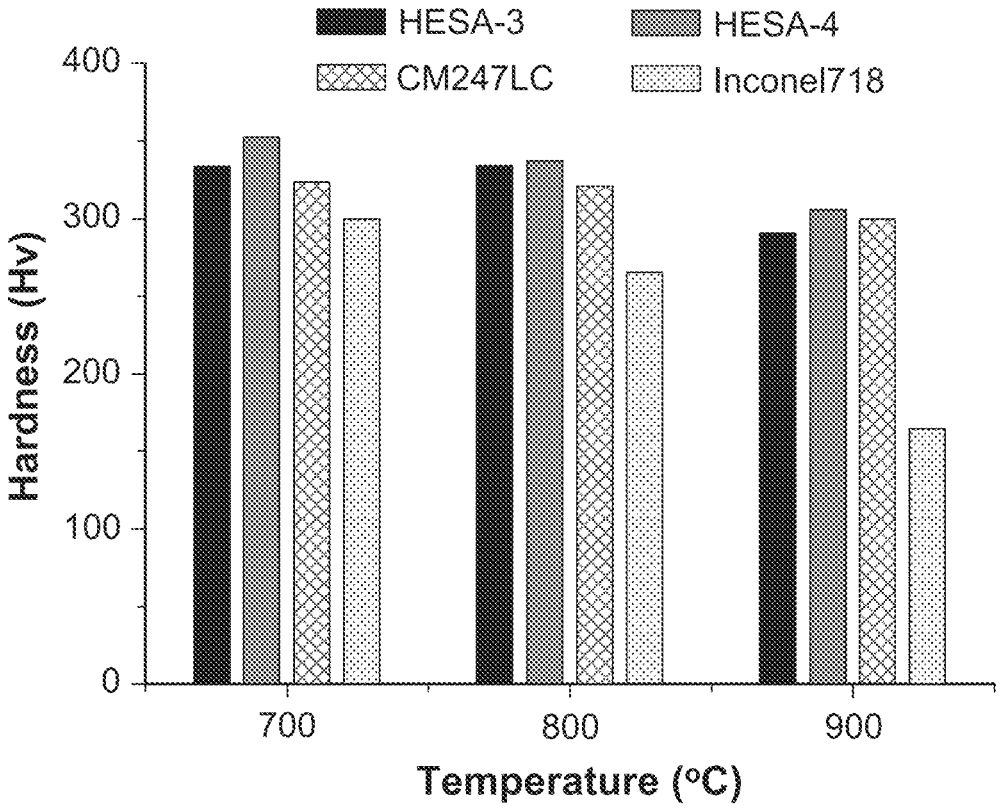
FIG. 3 shows a statistics bar chart of temperature versus hardness of different high-entropy superalloy samples.

Analysis of High-Temperature Mechanical Properties:

Please refer to FIG. 2, which presents a statistics bar chart showing hardness values of different high-entropy superalloy samples. In FIG. 2, CM247LC is a notation meaning one kind of traditional nickel based superalloy. Moreover, from FIG. 2, it can easily know that the high-entropy superalloy sample of HESA-1 exhibits a strong hardness obviously higher than the CM247LC under room temperature. Please continuously refer to FIG. 3, which shows a statistics bar chart of temperature versus hardness of different high-entropy superalloy samples. In FIG. 3, inconel718 is a notation meaning one kind of commercial nickel-iron based superalloy. Moreover, from FIG. 3, it can understand that both the high-entropy superalloy samples of HESA-3 and HESA-4 exhibit a strong hardness greater than the CM247LC and the inconel718 under high temperature.

Figure 4:
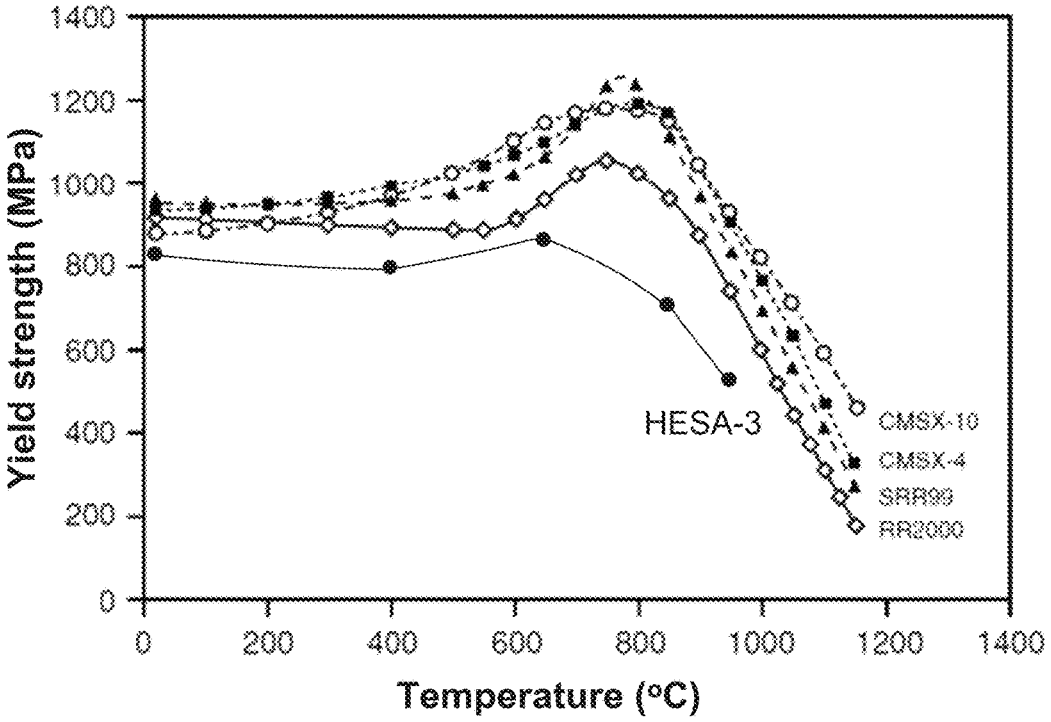
FIG. 4 shows five plotted curves of temperature versus yield strength of different high-entropy superalloy samples.

Continuously, please refer to FIG. 4, which shows five plotted curves of temperature versus yield strength of different high-entropy superalloy samples. The descriptions for the notations of CMSX-10, CMSX-4, SRR99, and RR2000 are integrated in following Table (6). Moreover, from FIG. 4, it can find that the high-temperature yield strength of the high-entropy superalloy sample of HESA-3 is close to RR2000's.

TABLE 6

| Notations | Descriptions |
|---|---|
| RR2000 | One kind of first generation superalloy |
| SRR99 | One kind of first generation superalloy |
| CMSX-4 | One kind of second generation superalloy |
| CMSX-10 | One kind of third generation superalloy |

Figure 5:
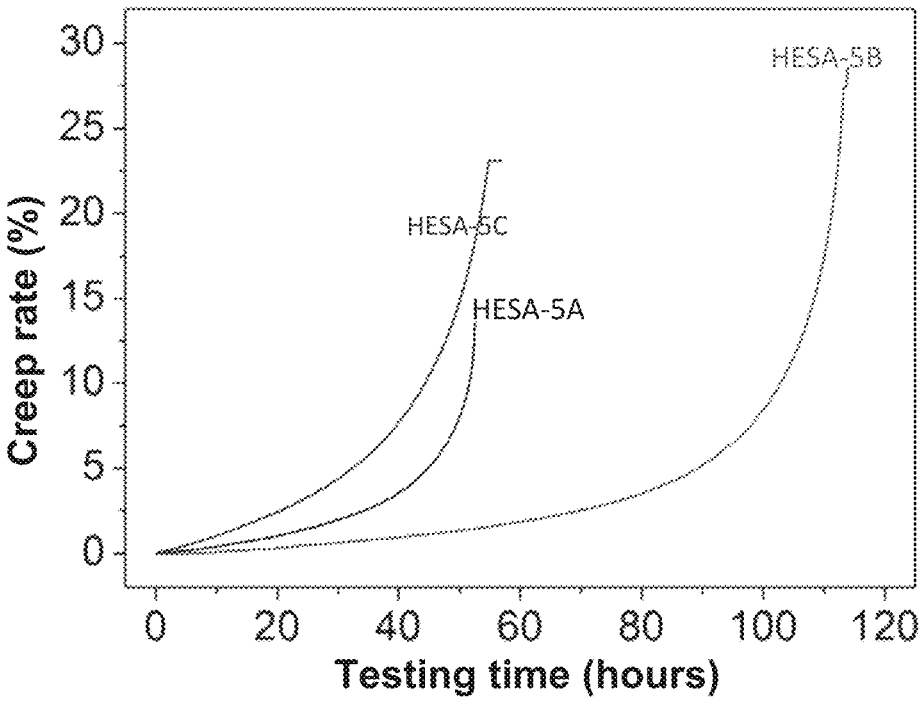
FIG. 5 shows three plotted curves of testing time versus creep rate of different high-entropy superalloy samples.

Please further refer to FIG. 5, which shows three plotted curves of testing time versus creep rate of different high-entropy superalloy samples. The data of creep rate plotted in FIG. 5 are measured by treating the high-entropy superalloy samples with a 150 Mpa strain under 982° C. Moreover, through FIG. 5, it can know that the high-entropy superalloy sample of HESA-5B exhibits outstanding high-temperature creep strength. On the other hand, following Table (7) records with the high-temperature creep strength data of various commercial $1^{st}$-generation superalloys. Comparing to the commercial $1^{st}$-generation superalloys, the high-temperature creep strength of the HESA-5B does closest approach to the $1^{st}$-generation superalloys'.

TABLE 7

| | Nickel based superalloy | | | |
|---|---|---|---|---|
| | IN100 DS | MAR-M 200 | NX-188 DS | RENE' 80 |
| Testing strain (MPa) | 159 | 179 | 138 | 145 |
| Rupture life (hours) | 154 | 94 | 58 | 118 |

Figure 6:
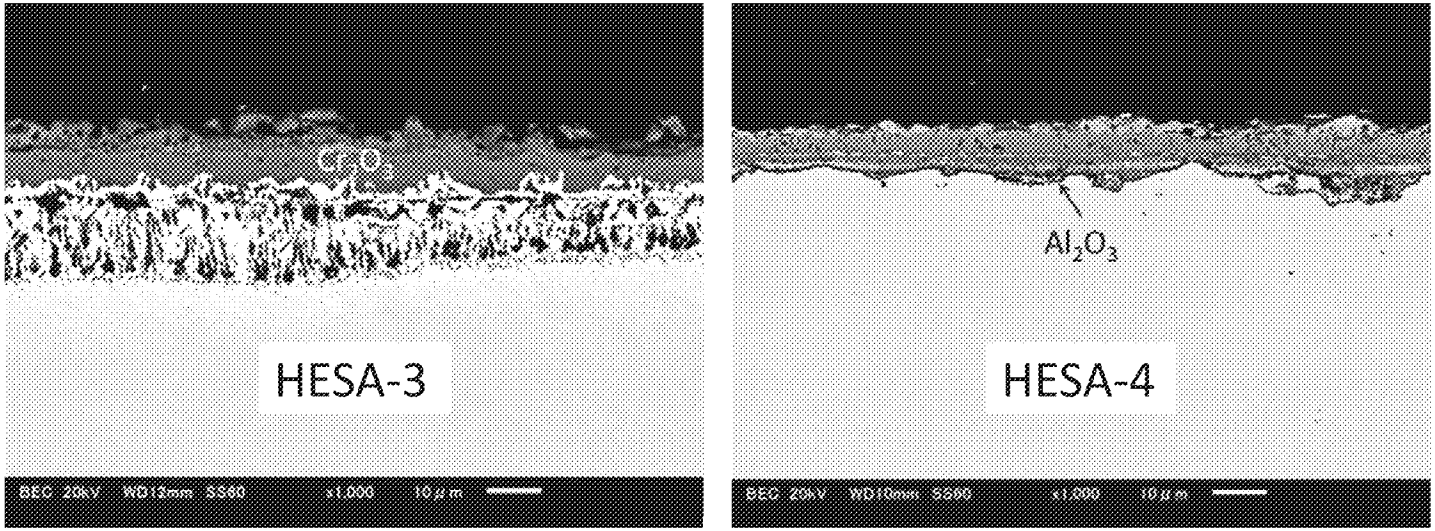
FIG. 6 shows two SEM images of different high-entropy superalloy samples.

Analysis of High-Temperature Oxidation Resistance:

Please refer to FIG. 6, which shows two SEM images of different high-entropy superalloy samples. From FIG. 6, it can find that a compact $Cr_2O_3$ or $Al_2O_3$ protection layer would form on the surface of the high-entropy superalloy under high temperature, wherein this compact protection layer can increase the corrosion resistance and oxidation resistance of the high-entropy superalloy because of having excellent thermal stability.

Figure 7:
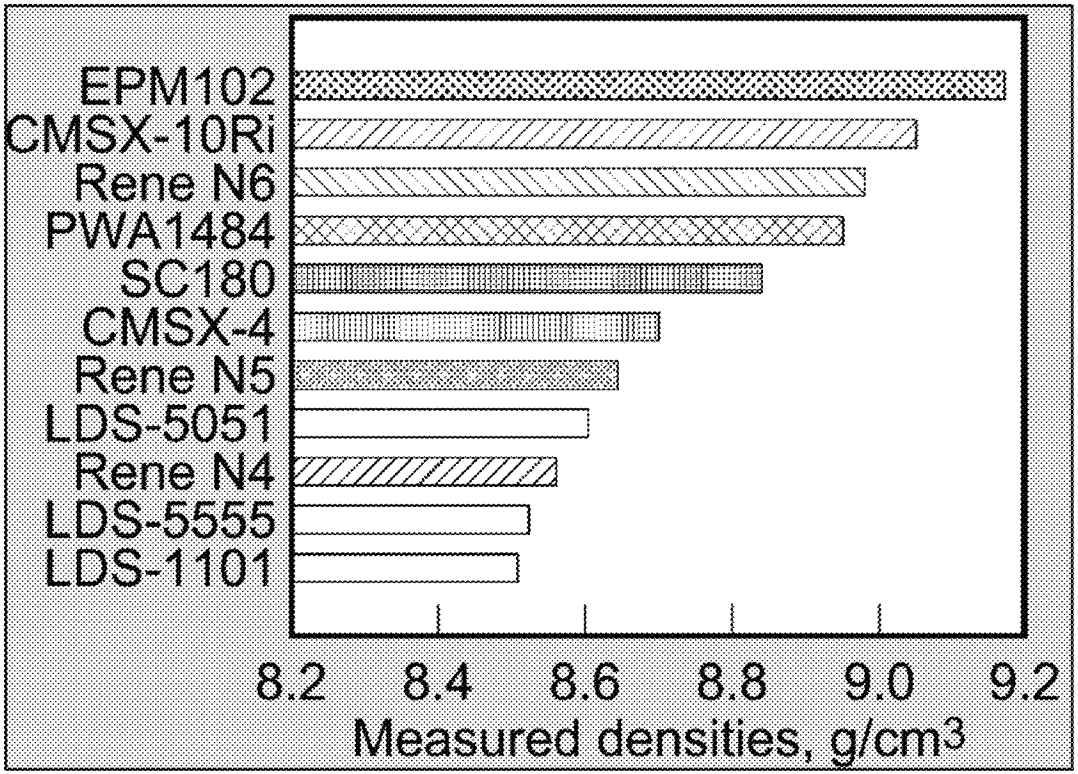
FIG. 7 shows a bar chart of density versus commercial superalloys.

Density Analysis:

Please refer to FIG. 7, which shows a bar chart of density versus commercial superalloys. Form FIG. 7, it is clear that, the density values of commercial superalloys is ranged from 7.8-9.4 g/cm$^3$ although parts of them perform excellent high-temperature creep strength. So that, the measurement data have proved that the high-entropy superalloy proposed by the present invention shows an advantage of light weight because of having the particular physical property of low density.

TABLE 8

| | Samples | | | | |
|---|---|---|---|---|---|
| | HESA-1 | HESA-2 | HESA-3 | HESA-4 | Commercial superalloy |
| Density (g/cm$^3$) | 7.78 | 7.73 | 7.64 | 7.94 | 7.8-9.4 |

Continuously, please refer to following Table (9-1) and Table (9-2), where detail elemental compositions for constituting the $1^{st}$- $4^{th}$ generation superalloy, the nickel-iron based superalloy, and the high-entropy superalloy of the present invention are integrated and listed. As the engineers skilled in the alloy developing and manufacturing field know, when a superalloy simultaneously contains high-content iron (Fe) and aluminum (Al) with the weight percentage exceeding 5 wt %, at least one intermetallic phase not belonging to any precipitation strengthening phases would be produced in the internal of the nickel-iron based superalloy, and the intermetallic phase such as $Ni_2AlTi$ or Ni(Al, Ti) would decrease the high-temperature creep strength and the high-temperature mechanical properties of the superalloy.

TABLE 9-1

| Sample | Ni at % | Al at % | Fe at % | Co at % | Cr at % | Nb at % |
|---|---|---|---|---|---|---|
| 5 | 43.9 | 3.9 | 11.8 | 22.3 | 11.7 | — |
| 6 | 51.0 | 5.0 | 9.0 | 18.0 | 7.0 | — |
| 10 | 61.7 | 5.6 | — | 9.2 | 8.1 | — |
| 11 | 57.8 | 5.6 | — | 9.0 | 6.5 | — |
| 12 | 69.7 | 5.7 | — | 3.0 | 2.0 | — |
| 13 | 50.5 | 5.6 | — | 16.5 | 2.0 | — |
| 14 | 52.5 | 0.5 | 18.5 | — | 19.0 | 5.1 |

TABLE 9-2

| Sample | Ti at % | Ta at % | Mo at % | W at % | Re at % | Ru at % | Remark |
|---|---|---|---|---|---|---|---|
| 5 | 6.4 | — | — | — | — | — | HESA-3 |
| 6 | 5.0 | 2.0 | 1.5 | 1.5 | — | — | HESA-4 |
| 10 | 0.7 | 3.2 | 0.5 | 9.5 | — | — | $1^{st}$ generation superalloy |
| 11 | 1.0 | 6.5 | 0.6 | 6.0 | 3.0 | — | $2^{nd}$ generation superalloy |
| 12 | 0.2 | 8.0 | 0.4 | 5.0 | 6.0 | — | $3^{rd}$ generation superalloy |
| 13 | — | 8.3 | 2.0 | 6.0 | 6.0 | 3.0 | $4^{th}$ generation superalloy |
| 14 | 0.9 | — | 3.0 | — | — | — | Inconel 718 |

From Table (9-1) and Table (9-2), it can find that the 0-$4^{th}$ generation supperalloy does not contain any elemental composition of iron (Fe), and the commercial nickel-iron based supperalloy (i.e., Inconel 718) simultaneously contains a trace amount of aluminum (Al) and a large amount of iron (Fe). However, the high-entropy superalloy proposed by the present invention simultaneously contains iron (Fe) composition with high element content and aluminum (Al) composition with relatively-high element content. Interestingly, besides showing an advantage of light weight, the measurement data proves that the high-entropy superalloy of the present invention also simultaneously possesses a variety of excellent high-temperature mechanical properties, such as high mechanical strength, high corrosion resistance, high oxidation resistance, and high creep resistance.

During the experiments for developing the high-entropy superalloy of the present invention, inventors of the present invention find that the production of the intermetallic phase not belonging to precipitation strengthening phases would be inhibited by adding a proper amount of titanium (Ti) into superalloy. Moreover, as FIG. 1 shows, the adding of Ti makes the ordered γ' phase with L12 crystal structure be produced in the base phase structure I of the high-entropy superalloy simultaneously contains iron (Fe) composition with high element content and aluminum (Al) composition with relatively-high element content.

Therefore, through above descriptions, the high-entropy superalloy proposed by the present invention has been introduced completely and clearly; in summary, the present invention includes the advantages of:

(1) Differing from traditional alloys often containing one primary elemental composition, the present invention reforms a conventional superalloy to a high-entropy superalloy by redesigning the elemental compositions of the conventional superalloy based on a mixing entropy formula. Particularly, this high-entropy superalloy shows advantages of light weight and low cost under the premise of containing a low amount of expensive metal composition.

(2) The proposed high-entropy superalloy of the present invention comprises a primary elemental composition and at least one principal strengthening elemental composition, wherein the primary elemental composition has a first element content of at least 35 at % and each of the principal strengthening elemental compositions have a second element content of over 5 at %. Moreover, a variety of experimental results have proved that the high-entropy superalloy simultaneously possesses a variety of excellent high-temperature mechanical properties, such as high mechanical strength, high corrosion resistance, high oxidation resistance, and high creep resistance.

(3) On the other hand, it is worth mentioning that the high-entropy superalloy of the present invention can be made by using atmospheric melting method, vacuum arc melting method, vacuum induction melting method, electric resistance wire heating method, electric induction heating method, rapidly solidification method, mechanical ball-milling method, powder metallurgic method, or additive manufacturing method. Moreover, because a product or a semi-product of the high-entropy superalloy can be a powder, a wire, a welding rod, a cored wire, or a bulk, the high-entropy superalloy can be coated on the surface of a target workpiece by casting method, electric-arc welding method, thermal spraying method, or thermal sintering method.

The above description is made on embodiments of the present invention. However, the embodiments are not intended to limit scope of the present invention, and all equivalent implementations or alterations within the spirit of the present invention still fall within the scope of the present invention.

What is claimed is:

1. A high-entropy superalloy, comprising:

at least one primary element, being a siderophile element Ni for forming a base phase structure of the high-entropy superalloy; wherein the primary element has a first element content of at least 35 at %;

at least one principal strengthening element for forming at least one precipitation strengthening phase structure, wherein the principal strengthening elemental composition is selected from the group consisting of aluminum (Al), cobalt (Co), chromium (Cr), copper (Cu), iron (Fe), manganese (Mn), niobium (Nb), titanium (Ti), vanadium (V), zirconium (Zr), or combination of the aforesaid two or more elements, and each of the at least one principal strengthening element has a second element content of over 5 at %; and at least one refractory element having a refractory element content of less than 7 at %;

wherein the first element content and the second element content are determined by a mixing entropy of the primary element and the at least one principal strengthening element, and an absolute value of the mixing entropy being over 1.5 R.

2. The high-entropy superalloy of claim 1, further comprising at least one grain boundary strengthening element having a third element content of less than 7 at %.

3. The high-entropy superalloy of claim 1, being made by using a manufacturing method selected from the group consisting of atmospheric melting method, vacuum arc melting method, vacuum induction melting method, electric resistance wire heating method, electric induction heating method, rapidly solidification method, mechanical ball-milling method, powder metallurgic method, and additive manufacturing method.

4. The high-entropy superalloy of claim 1, wherein the base phase structure is a face centered cubic (FCC) structure.

5. The high-entropy superalloy of claim 1, wherein a product or a semi-product of the high-entropy superalloy can be a powder, a wire, a welding rod, a cored wire, or an ingot.

6. The high-entropy superalloy of claim 1, being able to be coated on a surface of a target workpiece by a processing method selected from the group consisting of casting method, electric-arc welding method, thermal spraying method, and thermal sintering method.

7. The high-entropy superalloy of claim 2, wherein the grain boundary strengthening element is selected from the group consisting of carbon (C), boron (B), hafnium (Hf), combination of the aforesaid two or more elements.

8. The high-entropy superalloy of claim 1, wherein the refractory element is selected from the group consisting of molybdenum (Mo), tantalum (Ta), tungsten (W), rhenium (Re), and ruthenium (Ru).

* * * * *